US006280077B1

(12) United States Patent
Sullivan, Jr.

(10) Patent No.: US 6,280,077 B1
(45) Date of Patent: Aug. 28, 2001

(54) LINER FOR A MIXING CONTAINER AND AN ASSEMBLY AND METHOD FOR MIXING FLUID COMPONENTS

(75) Inventor: Joseph J. Sullivan, Jr., Scituate, MA (US)

(73) Assignee: CDF Corporation, Plymouth, MA (US)

( * ) Notice: Subject to any disclaimer, the term of this patent is extended or adjusted under 35 U.S.C. 154(b) by 0 days.

(21) Appl. No.: 09/548,073

(22) Filed: Apr. 12, 2000

(51) Int. Cl.[7] ..... B01F 7/20; B01F 15/00

(52) U.S. Cl. ..... 366/247; 366/349; 366/605; 220/495.01

(58) Field of Search ..... 366/349, 247, 366/605, 241, 242–251; 220/495.01, 495.02

(56) References Cited

U.S. PATENT DOCUMENTS 3,027,044 * 3/1962 Winstead .
3,126,197 * 3/1964 Bergstrom .
4,171,751 * 10/1979 Schutz .
4,521,116 * 6/1985 Adsit .
4,635,814 * 1/1987 Jones .
5,302,017 * 4/1994 Platek et al. .
5,337,914 * 8/1994 Mulder .
5,441,341 * 8/1995 Halsted .
5,727,878 * 3/1998 Sullivan, Jr. ..... 366/605

* cited by examiner

*Primary Examiner*—Tony G. Soohoo
(74) *Attorney, Agent, or Firm*—Pandiscio & Pandiscio

(57) ABSTRACT

A liner for use in a mixing container which is adapted to receive a mixing shaft having an open tubular distal end and having mixing members mounted thereon for mixing materials disposed in the container, includes a tubular sleeve substantially closed at a first end thereof by an end wall and open at a second end thereof, and an elongated substantially rigid protrusion fixed to the interior of the sleeve end wall centrally of the sleeve end wall, extending toward the second end of the sleeve, and adapted to receive thereon the open tubular distal end of the shaft.

19 Claims, 7 Drawing Sheets

LINER FOR A MIXING CONTAINER AND AN ASSEMBLY AND METHOD FOR MIXING FLUID COMPONENTS

BACKGROUND OF THE INVENTION

1. Field of the Invention

This invention relates to the mixing of fluid components and is directed more particularly to a liner for use with mixing containers, and an assembly and method for mixing fluid components in a liner-equipped mixing container.

2. Description of the Prior Art

The mixing of paint in facilities wherein paint is used on a large scale, as, for example, in automotive production plants, often is conducted in metal drums, e.g., common 55 gallon drums, equipped with a short upstanding post fixed to the center of the interior bottom surface.

Referring to FIG. 1, it will be seen that a typical prior art mixing assembly includes a 55 gallon cylindrical container 10 having a closed end wall 12 and an open end 14. A post 16 is affixed to and upstands about 2¼ inches, or so, from the interior surface 18 of the closed end wall 12.

The assembly further includes a mixing shaft 20 to which there are fixed mixing elements, such as blades 22. Mixing shaft 20 is hollow, or else it has a cavity 24 at its bottom end so as to permit the mixing shaft to be rotatably mounted on post 16. The shaft 20 extends through a central opening 26 in a cover member 28.

In operation, a fluid, typically comprising two or more paint components, is introduced into the container 10 to a suitable level. The mixing shaft 20, with cover member 28 thereon, is then placed in the container 10. The bottom end 24 of the shaft 20 is positioned so that post 16 is received by the shaft bottom end. Cover member 28 is secured to the top of the container 10 to close the otherwise open end 14 thereof. This results in the shaft 20 being generally aligned with the longitudinal axis of container 10. The blades 22 are rigid and extend close to, and are spaced from, the interior surface of side wall 15 of container 10.

The top end 32 of the mixing shaft 20 is then engaged by an electrically-powered turning device (not shown) which turns the shaft 20, thereby moving the blades 22 through the fluid. Alternatively, the upper end of the shaft can be coupled to a manually-operated turning mechanism (also not shown).

Upon completion of the mixing operation, cover member 28 and mixing shaft 20 with blades 22 are removed from the container 10. The mixed paint is then transferred to other containers or used directly from the container 10. In either case, the container 10 is not suitable for further like use and hence must be discarded. Disposal of the 55 gallon metal containers is objectionable because (1) the modified 55 gallon drums are expensive (typically costing more than $20 per drum) and (2) the drums are relatively large and disposing of thousands of drums involves a large disposal volume.

In an effort to render the mixing containers reusable, there has been provided a liner 40 (FIG. 2) for use with the mixing container 10 (FIG. 3). The liner 40 comprises a sleeve 42 closed off by a bottom end wall 44 thereof and having an open top end 46. Liner 40 is of a configuration generally complementary to the interior configuration of container 10. Sleeve 42 is of a flexible fluid-impervious material, preferably polyethylene or another flexible fluid-impervious plastic material.

A fitment 50 is fixed to an interior surface 48 of the bottom end wall 44 of the sleeve 42 and is open at a bottom end 52 (FIG. 2) thereof, and closed at a top end thereof. The fitment 50 is of an elongated configuration generally complementary to the configuration of the post 16. The bottom end wall 44 of the sleeve 42 defines a hole 56 (FIG. 2) in alignment with the fitment open bottom end 52. The fitment 50 may be provided with a flange portion 58 by which the fitment 50 is affixed to the interior surface 48 of the sleeve bottom end 44, as by adhesive, ultra-sonic welding, heat sealing, or other bonding process.

Fitment 50 preferably is of a plastic material or a high density elastomer. The fitment 50 is relatively stiff so as to resist twisting in response to rotation of shaft 20.

In operation, the liner 40 is inserted into the container 10, with the fitment 50 fitting over and receiving post 16 through the hole 56 and open bottom end 52 of the fitment 50. The fluid (e.g. paint components) is then poured into the open end of liner 40, causing the liner 40 to be pressed against the side and bottom end walls 15, 12 of the container 10. The mixing shaft 20 is inserted into the container 10 over the fitment 50 and post 16. The cover 28 is pressed down over the open end 46 of sleeve 42 and a complementary rim 49 of container 10 to lock the cover 28 to the upper end 14 of the container 10, to close the assembly (FIG. 3). The mixing shaft 20 is then rotated by a rotative apparatus engaged with the shaft top end 32.

Upon completion of the mixing operation, cover 28 and mixing shaft 20 are removed from the container 10, and the mixed paint (or other fluid) is removed form the container. Upon emptying the container, the liner 40 is stripped from the container, the interior of which has been protected by the removed liner from contact with the fluid.

The liner may be made with a relatively small wall thickness. Since it also is flexible, the liner 40 may be folded into a relatively small volume of space for disposal purposes, while the container may be re-used. The cost of liner 40 is much less than the cost of the container 10, and the space required for disposal of the liner 40 is very much less than the space required for disposal of the container 10.

The above-described liner and associated assembly and method is shown and described in U.S. Pat. No. 5,727,878, issued Mar. 17, 1998 to Joseph J. Sullivan, Jr. While the liner has successfully rendered mixing drums, even paint mixing drums, reusable, providing for the post 16 contributes substantially to the cost of the drum and, once done, limits the market for the drum to essentially purchasers having need for mixing containers. That is, the expense added to the manufacture of the drum tends to remove the drum from the general market and confine sales of the drum to a specialty niche. From the perspective of the users of mixing drums, the drums with posts mounted therein are substantially more expensive than the standard drum.

There is thus a need for a mixing assembly wherein the mixing container is an ordinary unmodified drum, and the cost of a mixing enabler is less expensive.

SUMMARY OF THE INVENTION

Accordingly, an object of the invention is to provide a plastic liner which may be inserted into a mixing container prior to a fluid mixing operation, which liner constitutes a barrier between the container and the fluid components therein, and which liner is provided with a protrusion thereon on which a mixer shaft may be mounted.

A further and more specific object is to provide a liner as set forth immediately above for use with a paint mixing container.

A still further object of the invention is to provide an assembly for mixing fluid components, wherein a liner constitutes a barrier between the container and the fluid therein and serves to support a mixing device in the container.

A still further object is to provide a method for mixing fluid components in a container wherein a liner constitutes a barrier between the container and the fluid therein, and further provides support for a mixing device in the container.

With the above and other objects in view, as will hereinafter appear, a feature of the present invention is the provision of a liner for use in a mixing container, the container being adapted to receive a mixing shaft having an opening in its distal end and having mixing members mounted thereon for mixing materials disposed in the container. The liner comprises a tubular sleeve substantially closed at a first end thereof by an end wall and open at a second end thereof, and an elongated shaft-retaining member in the form of a substantially rigid protrusion fixed to the interior of the sleeve end wall centrally of the sleeve end wall, extending toward the second end of the sleeve and adapted to telescopically receive thereon the tubular distal end of the shaft.

In accordance with a further feature of the invention, there is provided a liner for use with a paint mixing container having a bottom wall and an upstanding circular side wall, and adapted to receive a mixing shaft having an opening at its distal end and mixing members extending outwardly from the shaft. The liner comprises a flexible fluid-impervious sleeve substantially closed at a bottom end thereof and open at a top end thereof, the sleeve being of a configuration generally complementary to the interior configuration of the container. The liner further comprises a substantially rigid shaft-retaining member fixed to and upstanding from the interior bottom end of the sleeve, the shaft-retaining member being of a configuration compatible with the opening in the distal end of the mixing shaft. The liner is insertable into the container and is configured to conform substantially to the interior configuration of the container. The shaft-retaining member receives the distal end of the mixing shaft. The mixing shaft is turnable on the shaft-retaining member to move the mixing members through paint in the container, to mix the paint.

In accordance with a further feature of the invention, there is provided an assembly for mixing fluid components. The assembly comprises a mixing container having a closed first end and an open second end. A liner is provided for disposition within the container. The liner comprises a sleeve substantially closed at a first end thereof and open at a second end thereof, the sleeve having a configuration generally complementary to the interior configuration of the container, and a substantially rigid shaft-retaining member fixed to and upstanding from the closed first end of the sleeve. A mixing shaft is mountable over the shaft-retaining member and is provided with mixing members fixed thereon. The shaft is rotatable on the shaft-retaining member to move the mixing members in the liner. The sleeve constitutes a barrier between the container and the fluid components, and a support for the mixing shaft.

In accordance with a still further feature of the invention, there is provided a method for mixing fluid components, the method including the steps of providing a mixing container having a closed bottom end and an open top end, providing a cover member for the container, the cover member having a hole centrally thereof, providing a mixing assembly including a rotatable shaft and mixing members fixed to the shaft, the shaft having an open tubular bottom end, and providing a liner comprising a sleeve having a substantially closed bottom end and an open top end, the sleeve having a configuration generally complementary to the interior configuration of the container, the sleeve including a substantially rigid shaft-retaining member fixed to the bottom end of the sleeve and upstanding therefrom. The method further includes the steps of inserting the liner in the container, admitting the fluid components to the liner causing the liner to lie against the inner surfaces of the container, positioning the mixing assembly shaft in the liner on the shaft-retaining member, closing the open top end of the container with the cover member, the shaft extending through the hole in the cover member, and rotating the shaft on the liner rigid shaft-retaining member such that the mixing members move through and mix the fluid components.

The above and other features of the invention, including various novel details of construction and combinations of parts, and combinations of method steps, will now be more particularly described with reference to the accompanying drawings and pointed out in the claims. It will be understood that the particular devices and method steps embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
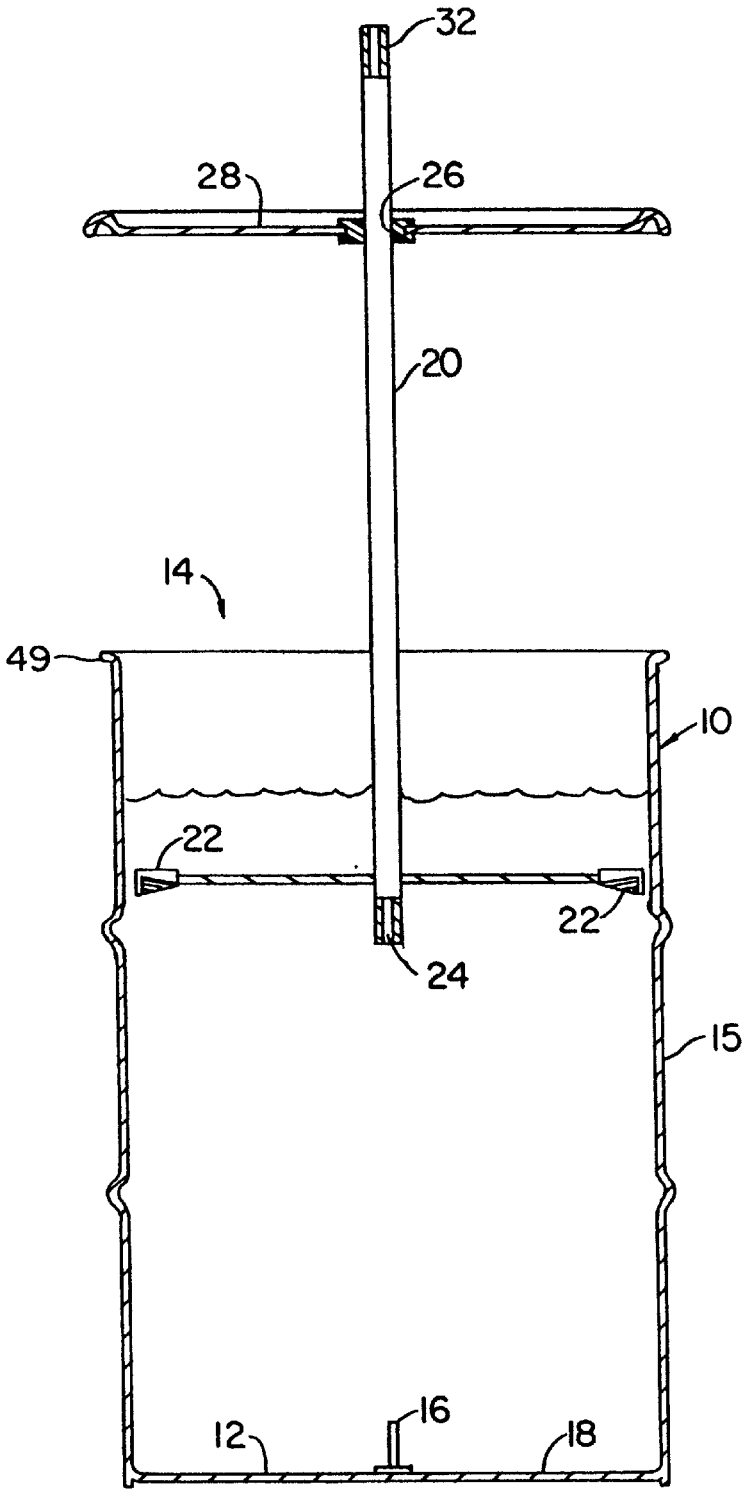
FIG. 1 PRIOR ART
FIG. 1 is an exploded generally sectional view, with portions broken away, of a prior art mixing assembly.
Figure 3:
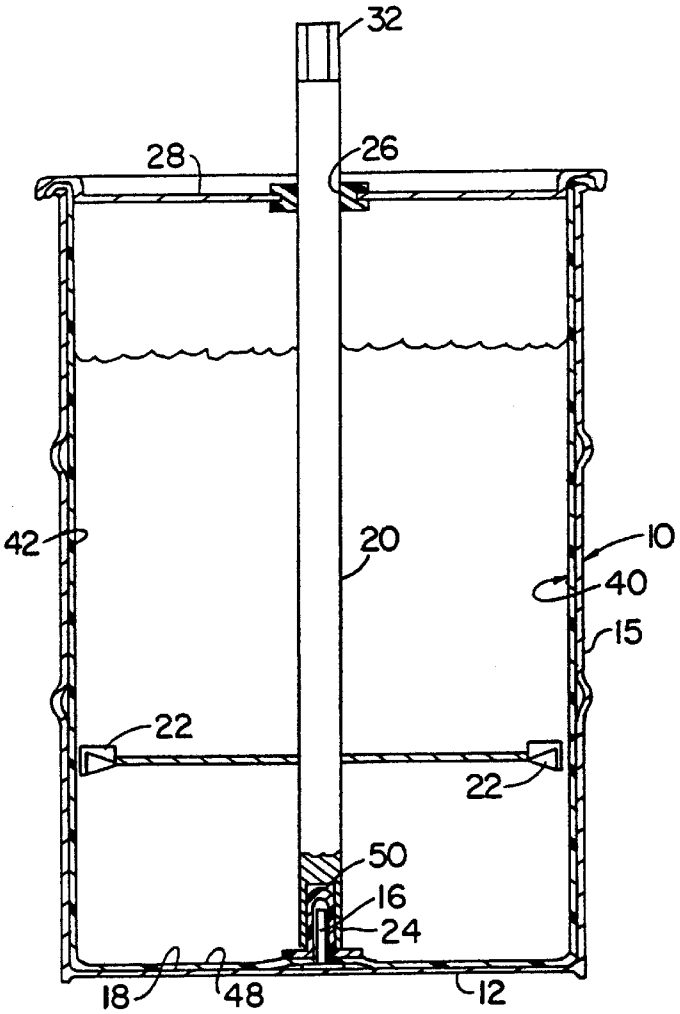
FIG. 3 PRIOR ART
FIG. 3 is a sectional view of the prior art liner of FIG. 2 in combination with the mixing assembly of FIG. 1.
Figure 2:
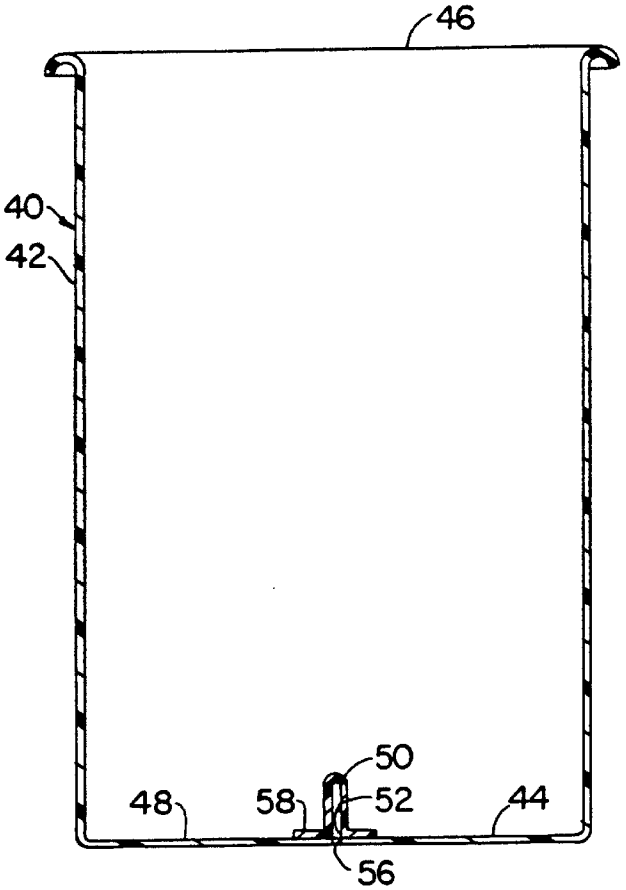
FIG. 2 PRIOR ART
FIG. 2 is a sectional view of a prior art liner for use with the mixing assembly of FIG. 1.
Figure 4:
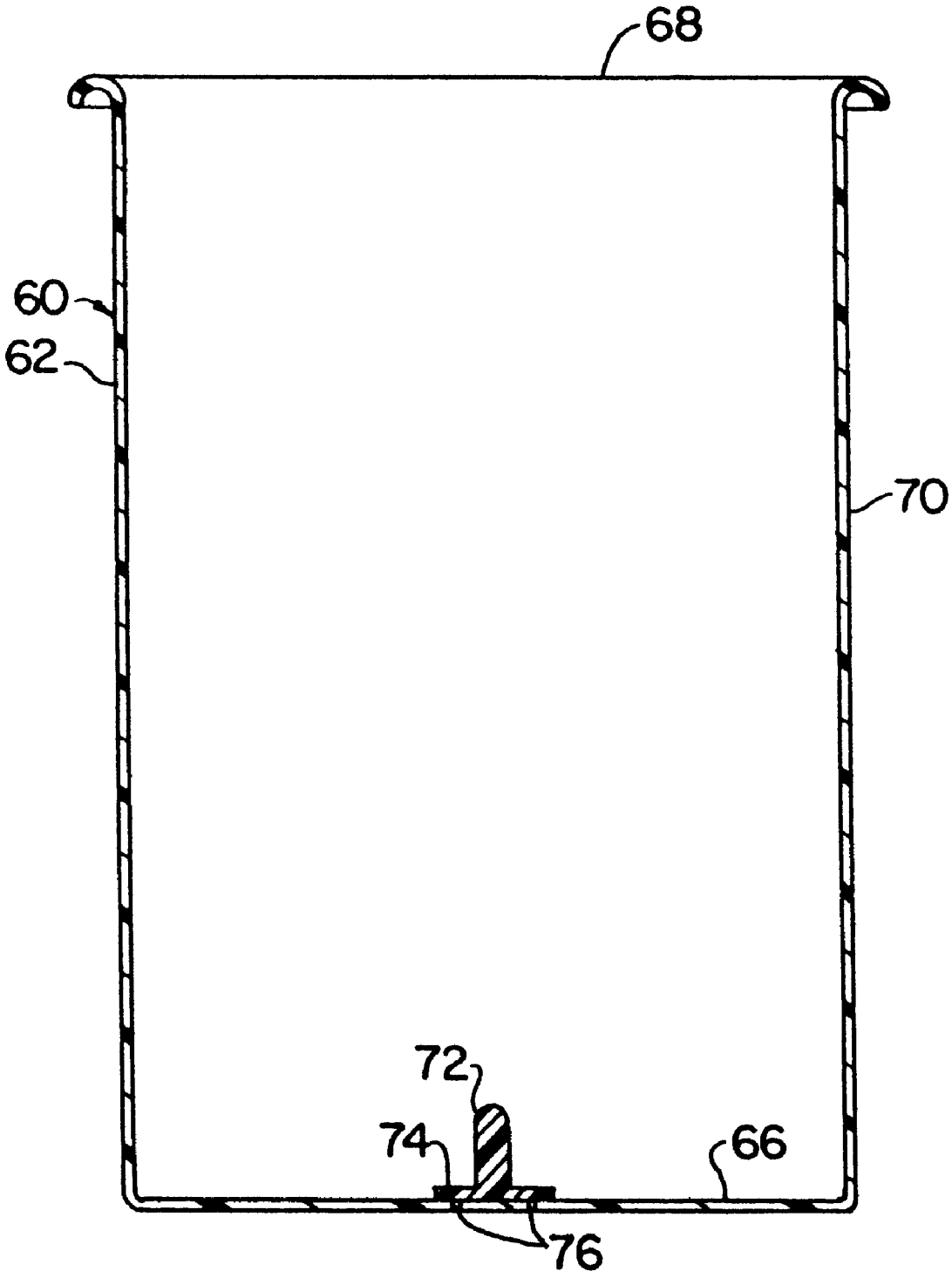
FIG. 4 is similar to FIG. 2 but showing one form of liner illustrative of an embodiment of the invention.

Referring to FIG. 4, it will be seen that a liner 60 for use with the mixing container 10 comprises a sleeve 62 closed at a bottom, or first, end thereof by an end wall 66 and open at a top, or second, end 68 thereof. The sleeve preferably is made of a suitable plastics material, e.g., polyethylene, with its sidewall 70 having a circular cross-sectional configuration generally complementary to the container 10. Preferably the sleeve is made of a flexible plastic, e.g., a low density polyethylene. The liner also may be made of another material, including by way of example but not limitation, polypropylene or a high density polyethylene (if the latter material is used, it is preferred that its thickness be minimized so that the sleeve will have some flexibility).

The liner 60 further comprises an elongated substantially rigid protrusion 72 fixed to the interior of the sleeve end wall 66 and extendible toward the open end 68 of the sleeve 62. The protrusion 72 preferably is a solid member of a high density polyethylene and is located at the center of end wall 66.

Figure 5:
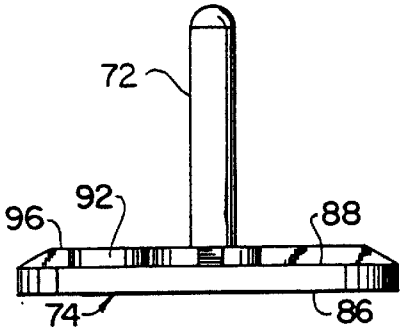
FIG. 5 is a side elevational view of the shaft-retaining component of the liner of FIG. 4.
Figure 6:
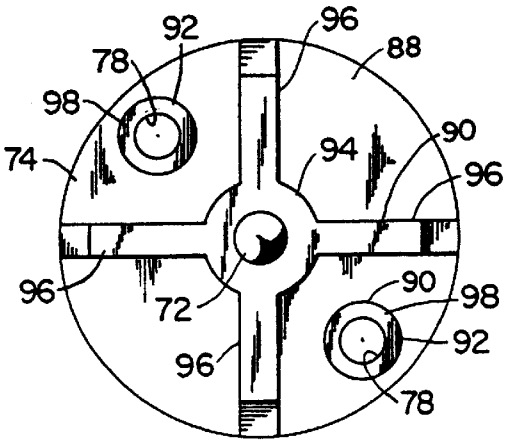
FIG. 6 is a top elevational view of the component of FIG. 5.
Figure 9:
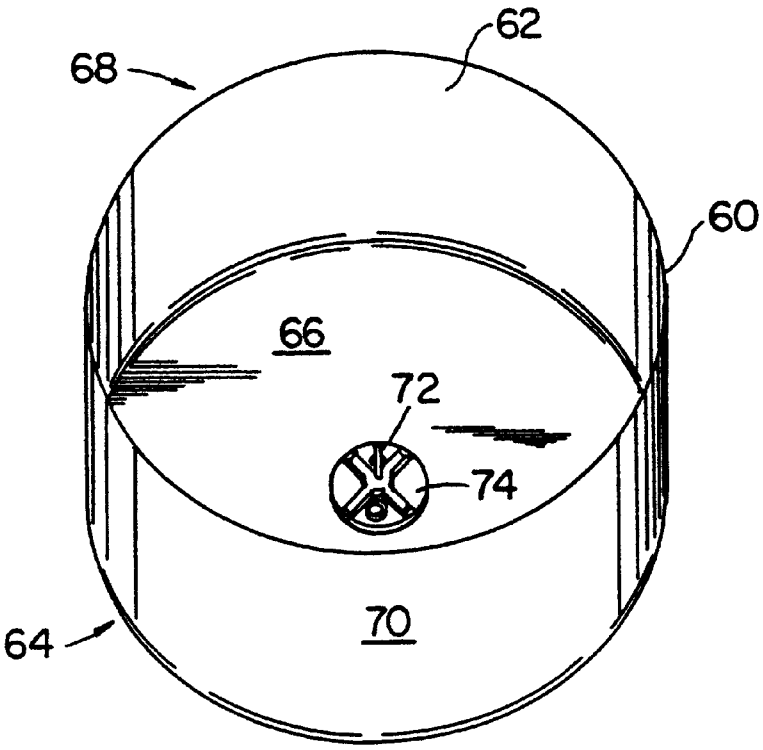
FIG. 9 is a generally top perspective view of the liner of FIG. 4.
Figure 10:
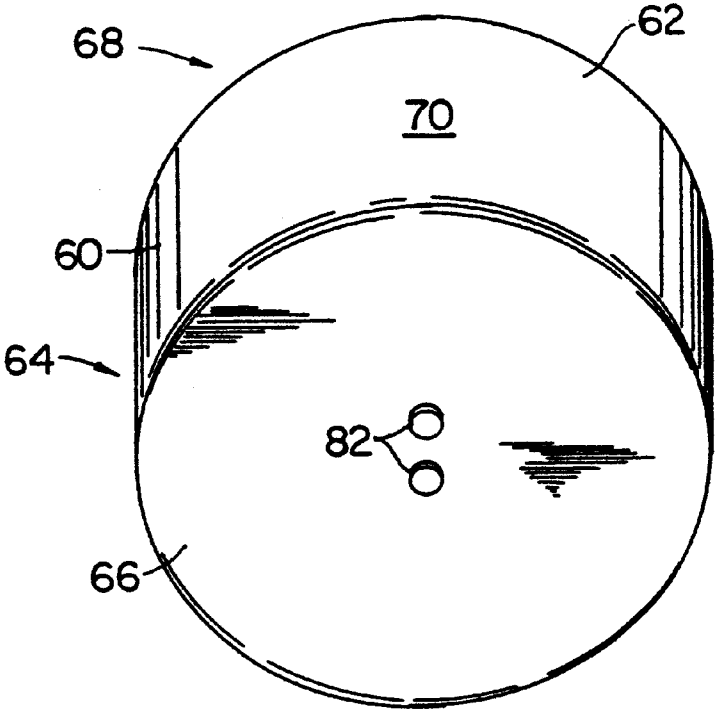
FIG. 10 is a generally bottom perspective view of the liner of FIG. 4.

Referring to FIGS. 5 and 6, it will be seen that the protrusion 72 is an integral extension of a disk 74 which is fixed to the sleeve end wall 66 (FIG. 4), with the protrusion and disk constituting an shaft-retaining member. The sleeve end wall 66 is provided with a plurality of holes 76 therethrough (FIG. 4). The disk 74 is similarly provided with holes 78 (FIG. 6), each of which is alignable with one of the holes 76.

Figure 7:
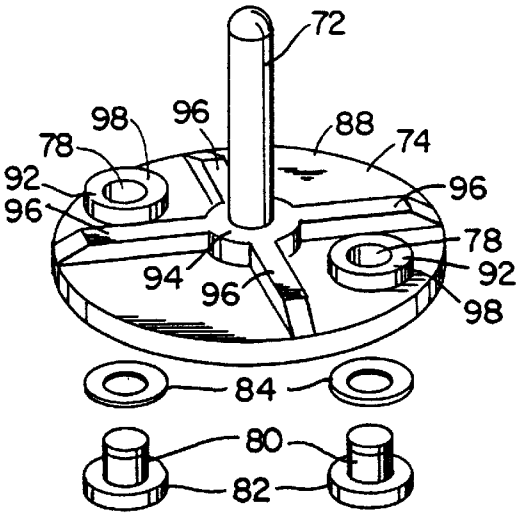
FIG. 7 is a generally top perspective view of the shaft-retaining component of FIGS. 5 and 6 in combination with fastener means.
Figure 8:
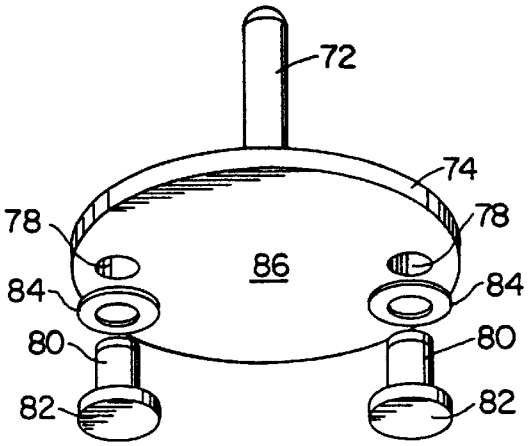
FIG. 8 is a generally bottom perspective view of the combination of FIG. 7.
Figure 12:
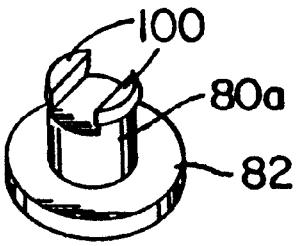
FIGS. 12 and 13 are perspective views of alternative embodiments of fastener means.
Figure 13:
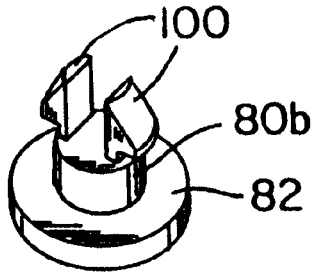

Pins 80 (FIGS. 7 and 8) are used for securing the shaft-retaining member to the sleeve end wall 66. Pins 80 are adapted to fit in aligned liner holes 76 and holes 78 of disk 74. The pins 80 may be "tight-fit" pins 80, as shown in FIGS. 7 and 8, which are sized to make a tight friction connection to disk 74. Alternatively, the pins may be of a "ring-snap" type 80*a* (FIG. 12) or a "hook snap" type 80*b* (FIG. 13), or any fastener suitable for securing members together. The "ring-snap" pins 80*a* are provided with opposed arc-shaped segments which may be squeezed toward one another to pass through the holes 76, 78 and are biased to snap outwardly to secure the pins 80*a* in place. Similarly, the "hook snap" pins 80*b* are provided with opposed hook-shaped segments which may be squeezed toward one another to pass through the holes 76, 78 and are biased to snap outwardly to secure the pins 80*b* in place. The pins 80, 80*a* and 80*b* may be made of various materials. Preferably, for reasons of cost and suitability, they are made of a high density polyethylene.

The pins 80, 80*a*, 80*b* are each provided with an enlarged head portion 82. As shown in FIGS. 7 and 8, sealing rings 84 of an elastomeric material are preferably disposed between the pin head portions 82 and the bottom end wall 66 of sleeve 62. Additionally or alternatively, sealing rings 84 may be disposed between the upper surface of sleeve end wall 66 and the planar bottom surface 86 of disk 74.

An upper surface 88 of the disk 74 may be provided with reinforcing structure 90 which preferably includes an upstanding ring 92 (FIGS. 6 and 7) around each of the disk holes 78 and an annular flange 94 surrounding the inner or base end of the protrusion 72. The reinforcing structure 90 may further include reinforcing ribs 96 upstanding from the upper surface 88 of the disk 74. In a preferred arrangement, shown in FIGS. 6 and 7, the ribs 96 extend from the flange 94 radially outwardly to the periphery of the disk 74.

In addition to reinforcing the disk 74, the reinforcing rings 92 provide flat upper surfaces 98 for engagement by the resilient legs 100 of the ring snap and hook snap types of pins 80*a*, 80*b* (FIGS. 12 and 13) to snap onto in fabrication of the liner 60.

The protrusion 72 and disk 74 forming the retaining member for mixing shaft 20 preferably are molded integrally as a single, unitary shaft-retaining member. High density polyethylene has been found to be a suitable material for the entire shaft-retaining member. A high density hard rubber may be used in place of high density polyethylene. Polypropylene, nylon or a polyester, also may be used for making the shaft retaining member 72, 74. Still other suitable materials will be obvious to persons skilled in the art.

Figure 14:
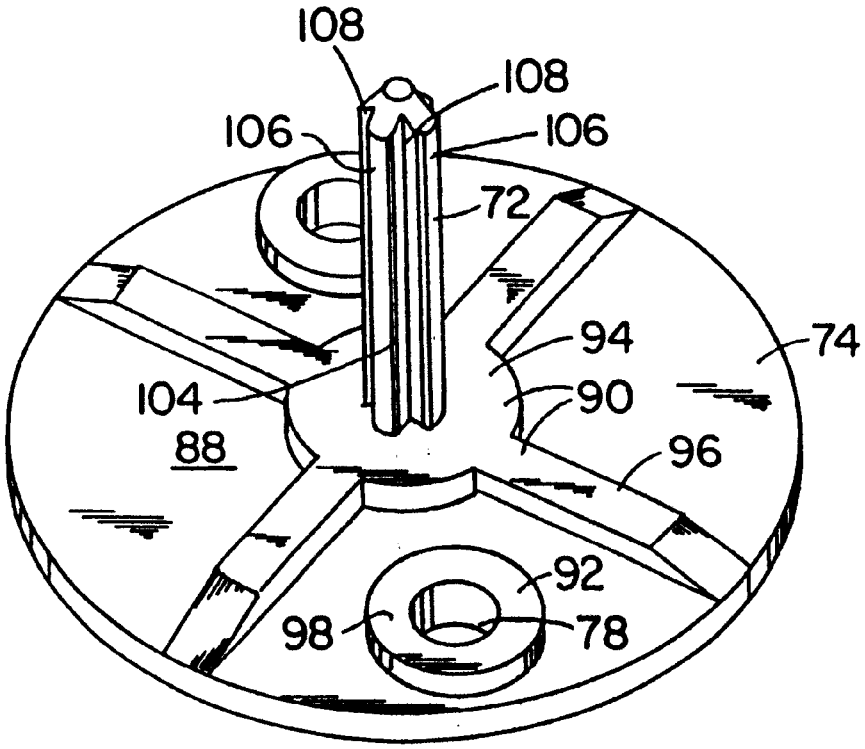
FIG. 14 illustrates an alternative form of shaft-retaining member.

Referring to FIG. 14, it will be seen that the protrusion 72 may be provided with a corrugated exterior surface 104, characterized by lands 106 and intervening grooves 108. Such a configuration reduces the area of contact between the protrusion 72 and the interior surface of the tubular distal end 24 of the mixing shaft 20, permitting the shaft 20 to turn on the protrusion 72 with less friction therebetween.

Figure 11:
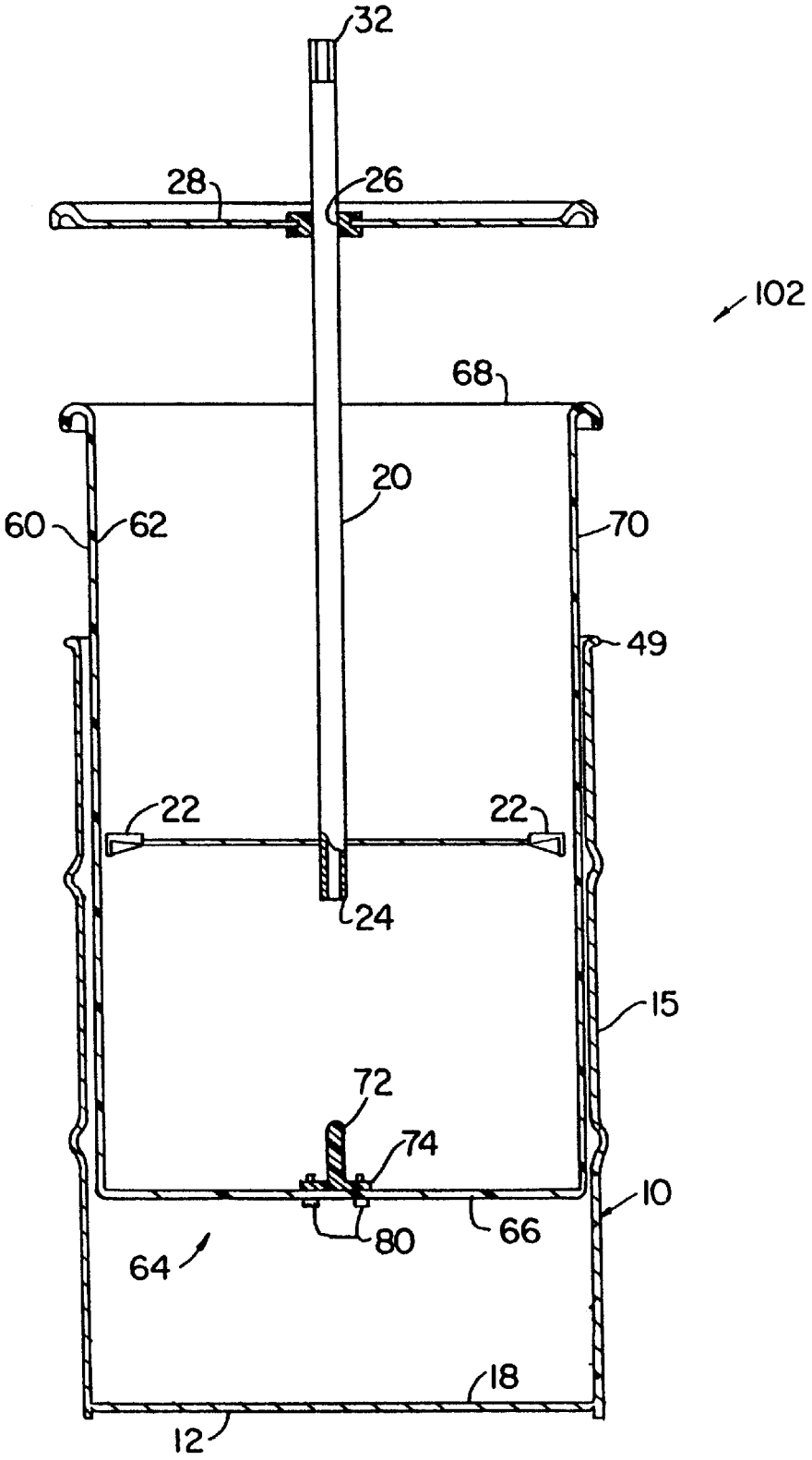
FIG. 11 is an exploded generally sectional view, with portions broken away, of a mixing assembly illustrative of a further embodiment of the invention.

Referring to FIG. 11, it will be seen that an assembly 102 for mixing fluid components includes the mixing container 10 and the mixing shaft 20 and attached components 22, 28 described hereinabove. The assembly 102 further includes the liner 60 which serves as a barrier between the container 10 and the fluid therein and, through the protrusion 72, serves as a mount for rotatably supporting the mixing shaft 20 and attached components.

In operation, the liner 60 is inserted into the container 10. The fluid components to be mixed are then admitted to the liner, causing the liner to be pressed against the inner surfaces of the container. The mixing assembly shaft 20 is then positioned in the liner on the protrusion 72. The cover member 28 is then pressed onto the top end 46 of the liner 60 and container rim 49 to close the assembly 102. The exposed upper end 32 of the shaft 20 is then rotated, to cause rotation of the shaft 20 on the protrusion 72 and movement of the mixing blades 22 through the fluid in the liner. Since the disk portion 74 of the shaft-retaining member is fixed to the bottom wall of the liner by pins 80, 80*a* or 80*b*, the protrusion 72 serves to retain the shaft 20 against lateral movement while also serving as a bearing to facilitate shaft rotation.

As is the case with liner 40, the liner 60 may be fabricated with a relatively small wall thickness, typically about 0.004 inch. Depending on the flexibility of the material of which the liner 60 is made, the liner may be folded into a relatively small volume for disposal purposes, while the container 10 may be reused for any purpose for which such containers find use. The cost of the liner 60 constitutes a fraction of the cost of the container 10 and the space required for disposal of the liner is very much less than the space required for disposal of the container. Further, inasmuch as the mixer-support protrusion 72 is part of the liner and not required in the container, the acquisition cost of the container is substantially reduced.

It is to be understood that the present invention is by no means limited to the particular construction herein disclosed and/or shown in the drawings, but also comprises any modification or equivalent within the scope of the claims. Thus it is contemplated that the disk 74 of the shaft retaining member may be secured to the bottom wall of the liner by means other than pins 80, 80*a* or 80*b*, e.g. by some other form of mechanical attachment means or by bonding with a high strength bonding agent or by heat sealing. It is envisioned further that the protrusion 72 need not be solid but instead may be hollow with its inner end closed off. A further possible modification is to form protrusion 72 separately from disk 74 and then to affix it to the disk so as to provide a shaft retaining member similar in appearance to that shown at 72 and 74 in FIGS. 4–8 and 14. Still other modifications will be obvious to persons skilled in the art from the foregoing description.

What is claimed is:

1. A liner for use in a mixing container, the container being adapted to receive a mixing shaft having an open distal end and having mixing members mounted thereon for mixing materials disposed in the container, the liner comprising:

a tubular sleeve substantially closed at a first end thereof by an end wall and open at a second end thereof; and an elongated solid protrusion fixed to the interior of said sleeve end wall centrally of said sleeve end wall, extendible toward the second end of said sleeve and adapted to receive thereon the open tubular distal end of the shaft.

2. The liner in accordance with claim 1 wherein said sleeve is of an elastomeric material.

3. The liner in accordance with claim 1 wherein said solid member is made of high density polyethylene or nylon or polypropylene or a polyester.

4. The liner in accordance with claim 1 wherein said protrusion extends from a disk fixed to said end wall of said sleeve.

5. The liner in accordance with claim 4 wherein said end wall of said sleeve is provided with a plurality of holes extending therethrough, and said disk is provided with holes each alignable with one of said sleeve end wall holes, and further comprising pins each for entering an aligned sleeve end wall hole and disk hole for securing said disk to said end wall.

6. The liner in accordance with claim 5 wherein said pin is a pin selected from a group of pins, said group consisting of tight fit pins, ring snap pins, and hook snap pins.

7. The liner in accordance with claim 5 wherein said disk is provided with a substantially planar surface for disposition on said sleeve end wall, and an upper surface having thereon reinforcing structure for said disk holes and said protrusion.

8. The liner in accordance with claim 7 wherein said reinforcing structure comprises an upstanding ring around each of said disk holes and a pedestal to which is fixed an end of said protrusion.

9. The liner in accordance with claim 8 wherein said reinforcing structure further comprises ribs upstanding from said upper surface and extending from said protrusion pedestal radially outwardly.

10. The liner in accordance with claim 7 wherein said pins are each provided with an enlarged head, and further comprising an O-ring for disposition between said head and said planar surface.

11. The liner in accordance with claim 4 wherein said disk and said protrusion comprise an integrally molded unitary member.

12. The liner in accordance with claim 1 wherein said protrusion is provided with an interrupted exterior surface for engagement with an interior surface of said tubular distal end of said shaft.

13. The liner in accordance with claim 12 wherein said interrupted exterior surface of said protrusion is defined by lands and grooves extending lengthwise of said protrusion.

14. A liner for use with a paint mixing container having a bottom wall and an upstanding circular side wall, and adapted to receive a mixing shaft having an open distal end and mixing members extending outwardly from the shaft, the liner comprising:

a fluid-impervious sleeve closed at a bottom end thereof and open at a top end thereof, said sleeve being adapted to assume a configuration generally complementary to the interior configuration of the container; and a solid protrusion fixed to and upstanding from the interior bottom end of said sleeve, said protrusion being of a configuration generally complementary to the configuration of the interior of the open distal end of the mixing shaft;

wherein said liner is insertable into the container and said protrusion is adapted to receive the distal end of the mixing shaft, the mixing shaft being turnable on said protrusion to move the mixing member through paint in the container, to mix the paint.

15. The liner in accordance with claim 14 wherein said protrusion is integral with a disk, said disk being fixed to said sleeve bottom end and said protrusion upstanding from said disk.

16. The liner in accordance with claim 15 wherein said integral disk and protrusion is of high density polyethylene and said liner is of a plastic material.

17. An assembly for mixing fluid components, the assembly comprising:

a mixing container having a closed first end and an open second end;

a liner for disposition, within said container, said liner comprising:

a sleeve closed at a first end thereof and open at a second end thereof, said sleeve having a configuration generally complementary to the interior configuration of said container; and a solid protrusion fixed to and upstanding from the closed first end of said sleeve; and a mixing shaft mountable over said protrusion and having mixing members fixed thereon, said shaft being rotatable on said protrusion to move said mixing members in said liner;

said liner constituting a barrier between said container and said fluid components, and further constituting a mount for rotatably supporting said mixing shaft.

18. The assembly in accordance with claim 17 and further comprising a cover member for closing said container open end and said sleeve open end, said mixing shaft extending through a hole in said cover member, said mixing members being disposed in said container and said sleeve, and a proximal end of said mixing shaft being disposed outside of said container and said sleeve, wherein rotation of the proximal end of the mixing shaft causes said mixing shaft to rotate on said protrusion and causes said mixing members to move through said fluid components to mix the fluid components in said liner.

19. A method for mixing fluid components, the method comprising the steps of:

providing a mixing container having a closed bottom end and an open top end;

providing a cover member for the container, the cover member having a hole centrally thereof;

providing a mixing assembly including a rotatable shaft and mixing members fixed to the shaft, said shaft having an open tubular bottom end;

providing a liner comprising a sleeve having a closed bottom end and an open top end, said sleeve having a configuration generally complementary to the interior configuration of the container, said sleeve including a solid protrusion fixed to the bottom end of the sleeve and upstanding therefrom;

inserting said liner in the container;

admitting the fluid components to the liner, causing the liner to lie against the inner surfaces of the container;

positioning the mixing assembly shaft on the liner rigid protrusion;

closing the open top end of the container with the cover member, the shaft extending through the hole in the cover member; and rotating the shaft on the liner rigid protrusion such that the mixing members move through and mix the fluid components.

* * * * *